US005774901A

United States Patent [19]

Minami

[11] Patent Number: 5,774,901

[45] Date of Patent: Jul. 7, 1998

[54] SPORT HELMET RETENTION APPARATUS

[75] Inventor: Don Satoshi Minami, Monte Sereno, Calif.

[73] Assignee: Bell Sports, Inc., San Jose, Calif.

[21] Appl. No.: 689,896

[22] Filed: Aug. 15, 1996

[51] Int. Cl.[6] ..... A42B 3/08

[52] U.S. Cl. ..... 2/421; 2/425

[58] Field of Search ..... 2/410, 411, 415, 2/416, 417, 418, 419, 420, 421, 422, 425

[56] References Cited

U.S. PATENT DOCUMENTS

| | | | |
|---|---|---|---|
| 1,522,024 | 1/1925 | Nixon, Jr. . | |
| 1,537,178 | 5/1925 | Maynard | 2/421 |
| 2,739,310 | 3/1956 | Frieder et al. | 2/418 |
| 2,846,683 | 8/1958 | Dye et al. | 2/421 |
| 3,087,166 | 4/1963 | Howard . | |
| 3,130,415 | 4/1964 | Colley | 2/415 |
| 3,139,623 | 7/1964 | Joseph, Jr. | 2/415 |
| 3,171,133 | 3/1965 | Steffen . | |
| 3,230,544 | 1/1966 | Mager | 2/415 |
| 3,323,134 | 6/1967 | Swyers | 2/421 |
| 3,354,468 | 11/1967 | Bowers, Jr. . | |
| 3,388,405 | 6/1968 | Simpson et al. | 2/418 |
| 3,591,863 | 7/1971 | Rickard | 2/421 |
| 3,790,962 | 2/1974 | Plastino | 2/411 |
| 3,852,821 | 12/1974 | Mickel | 2/421 |
| 3,925,821 | 12/1975 | Lewicki | 2/425 |
| 3,934,271 | 1/1976 | Rhee . | |
| 3,991,423 | 11/1976 | Jones | 2/415 |
| 3,992,722 | 11/1976 | Rhee | 4/424 |
| 4,000,520 | 1/1977 | Svendsen et al. | 2/418 |
| 4,011,600 | 3/1977 | Malk | 2/183 |
| 4,058,854 | 11/1977 | Rhee | 2/412 |
| 4,068,323 | 1/1978 | Gwon | 2/413 |
| 4,075,715 | 2/1978 | Cowgill | 2/421 |
| 4,263,679 | 4/1981 | Erlendson | 2/421 |
| 4,274,157 | 6/1981 | Boden | 2/181 |
| 4,279,038 | 7/1981 | Bruckner et al. | 2/425 |
| 4,477,929 | 10/1984 | Matteson | 2/425 |
| 4,534,068 | 8/1985 | Mitchell et al. | 2/414 |
| 4,642,817 | 2/1987 | Ferstenfeld | 2/183 |
| 4,845,782 | 7/1989 | Gregg | 2/172 |
| 4,856,119 | 8/1989 | Haberle | 2/417 |
| 4,884,301 | 12/1989 | Ailso | 2/909 |
| 4,993,079 | 2/1991 | Johnson | 2/181 |
| 5,010,598 | 4/1991 | Flynn et al. | 2/410 |
| 5,012,533 | 5/1991 | Raffler | 2/420 |
| 5,023,958 | 6/1991 | Rotzin | 2/421 |
| 5,079,780 | 1/1992 | Coombs et al. | 2/909 |
| 5,083,320 | 1/1992 | Halstead | 2/413 |
| 5,083,321 | 1/1992 | Davidsson | 2/421 |
| 5,121,508 | 6/1992 | Grilliot et al. | 2/421 |
| 5,129,108 | 7/1992 | Copeland et al. | 2/424 |
| 5,142,705 | 9/1992 | Edwards | 2/418 |
| 5,168,576 | 12/1992 | Krent et al. | 2/2 |
| 5,315,718 | 5/1994 | Barson et al. | 2/421 |
| 5,333,328 | 8/1994 | Roberts | 2/422 |
| 5,381,560 | 1/1995 | Halstead | 2/421 |
| 5,551,094 | 9/1996 | Navone | 2/421 |
| 5,581,819 | 12/1996 | Garneau | 2/421 |
| 5,608,918 | 3/1997 | Salvaggio | 2/421 |
| 5,638,551 | 6/1997 | Lallemand | 2/421 |

FOREIGN PATENT DOCUMENTS

| | | | |
|---|---|---|---|
| 394726 | 10/1990 | European Pat. Off. | 2/421 |
| 3632 525 A1 | 9/1986 | Germany . | |
| L172388 | 11/1969 | United Kingdom | 2/421 |
| 9501739 | 1/1995 | WIPO | 2/421 |

*Primary Examiner*—Michael A. Neas
*Attorney, Agent, or Firm*—Limbach & Limbach L.L.P.

[57] ABSTRACT

A sport helmet is disclosed having an inverted, generally Y-shaped, flexible back strap member spanning between a rear portion of the helmet and the helmet's chin straps to fully embrace the occipital region of the wearer's head for better helmet stability and retention. Because the back strap is a single, unitary member, the resulting retention system is simple, comfortable, easy to adjust, and costs less to manufacture.

18 Claims, 3 Drawing Sheets

SPORT HELMET RETENTION APPARATUS

BACKGROUND OF THE INVENTION

1. Field of the Invention

The present invention relates to sport helmets, in particular to a system for retaining and stabilizing a sport helmet on a wearer's head.

2. Discussion of the Prior Art

There currently is a wide variety of lightweight sport helmets available for head protection during bicycle riding, inline skating, kayaking and similar types of sports. These helmets have continuously evolved and undergone numerous improvements in recent years. One particular area of refinement has been in the fitting and stabilizing of helmets on a wearer's head. An example of a prior art bicycle helmet and a means for securing it from excessive movement is disclosed in U.S. Pat. No. 4,903,350, incorporated herein by reference.

In order to fit a variety of head shapes and sizes, a particular brand of helmet often will be available in several sizes. Each size typically can be customized to a particular wearer's head by inserting or removing cushions and pads around the interior of the helmet cavity to obtain a snug fit.

Chin straps are employed to keep the helmet on. These straps reduce the vertical movement of the helmet relative to the wearer's head, but provide little resistance to the forward and back rocking motion of the helmet. Many helmet models now employ chin straps having a "Y" configuration on each side. One version of this type of arrangement involves a two piece chin strap, with one strap connected to a front portion of the helmet and encircling the wearer's face, and a second strap connected to a rear portion of the helmet and encircling a rear portion the wearer's head. The two straps join together under each ear with adjustable slide members, and attach to a buckle under the wearer's chin. An example of this type of prior art helmet and strap arrangement is also disclosed by U.S. Pat. No. 4,903,350. While this type of chin strap reduces the amount of helmet movement, it does not eliminate it. This type of arrangement is also difficult to adjust given the number of adjustments and because changing one adjustment often affects the other adjustments.

The sport of mountain bike (i.e. off road bike) riding has become increasingly popular in recent years. Because riding on uneven terrain involves more bouncing and jarring than does riding on smooth surfaces, the problem of excessive helmet movement has received extra attention from helmet designers in the past several years. In addition to the Y-straps described above, helmet designers have begun to add various features on the back of the helmet to retain the occipital region of the rider's head (i.e. the undercut region of the back of the head at the top of the neck.)

The above devices suffer from one or more of the following drawbacks. Undue complexity makes it difficult for the wearer to adjust the retention system, and cumbersome to don and doff the helmet. This complexity also adds fabrication and assembly costs to manufacturing the helmet, which increases the purchase price of the helmet. Prior art devices often lack the ability to fully retain the helmet on the wearer's head during sport activity, especially during a fall when the helmet is prone to movement on the head or even complete disengagement from off of the head. Devices affording better retention are often accompanied by increased discomfort. Finally, many prior art systems require that a new helmet be designed to support the new retention system, rather than being able to retro-fit the system to an existing helmet design.

What is needed, and is not provided by the prior art, is a sport helmet retention system that provides a high degree of retention, while being simple, low cost, comfortable and easy to wear.

SUMMARY OF THE INVENTION

Broadly stated, the present invention, to be described in greater detail below, is directed to a sport helmet having an inverted, generally Y-shaped, flexible member spanning between a rear portion of the helmet and the helmet's chin straps to fully embrace the occipital region of the wearer's head.

In accordance with one aspect of the present invention, a sport helmet is provided with a flexible member and chin strap arrangement that embraces a larger portion of the wearer's head, allowing the helmet to be more securely retained with less movement on the head during normal sport activities and during accidents.

In accordance with another aspect of the present invention, the flexible member enhances performance while replacing one leg of the traditional Y-shaped chin strap, thereby reducing complexity of the helmet. The inventive helmet is simpler to use, as the only strap adjustment to be made is a one-time adjustment of the lower chin strap. Even without the multiple adjustment points found in the prior art helmets, a single helmet according to the present invention is able to fit a wide range of head sizes.

In accordance with still another aspect of the present invention, the flexible member is molded in a flat orientation from single piece of material. Slots are provided in the two forward arms of the member for slidably receiving the chin straps. The upper arm of the member has a bead formed along its upper edge to engage a T-slot member for securing the flexible member to the rear of the helmet. These features result in fewer parts, lower fabrication costs, and lower assembly costs.

In accordance with yet another aspect of the present invention, the above features of the flexible member and the simplicity of the inventive retention system allow the apparatus to be retro-fit to existing helmets with little or no re-designing of the helmet.

In accordance with yet another aspect of the present invention, the one-piece flexible member is designed to securely cradle the occipital region of the wearer's head, resulting in greater wearer comfort.

DETAILED DESCRIPTION OF THE PREFERRED EMBODIMENT

Figure 1:
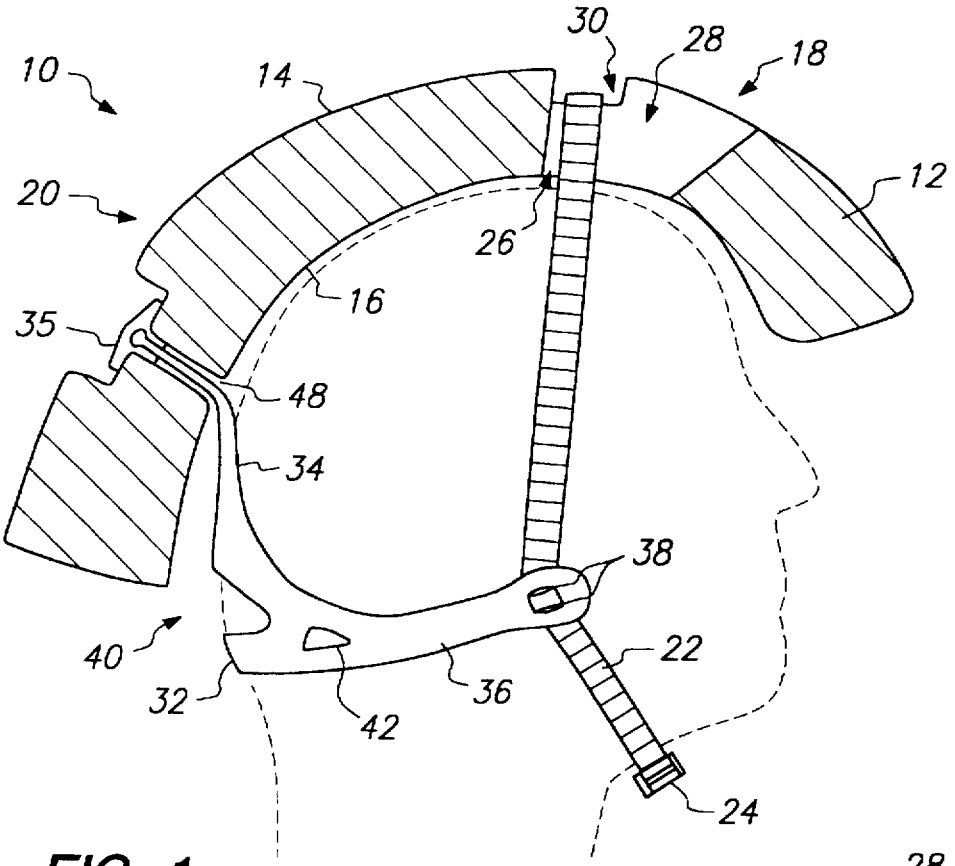
FIG. 1 is a fragmentary side elevational view of a sport helmet constructed according to the preferred embodiment of the invention.

Referring to FIG. 1, a helmet constructed according to the invention, and generally referred to with the numeral 10, is shown on a wearer's head. The shell assembly 12 of helmet 10 has exterior surface 14, and an interior surface 16 which defines a helmet cavity for fitting over the top portion of the wearer's head, as is well known in the art. Shell assembly 12 can be further defined by a front half 18 and a rear half 20.

A chin strap 22 is provided to help secure shell assembly 12 to the wearer's head. Chin strap 22 preferably is a single strap which generally encircles the perimeter of the wearer's face and is removably fastened under the wearer's chin by a two-piece plastic buckle 24.

Figure 2:
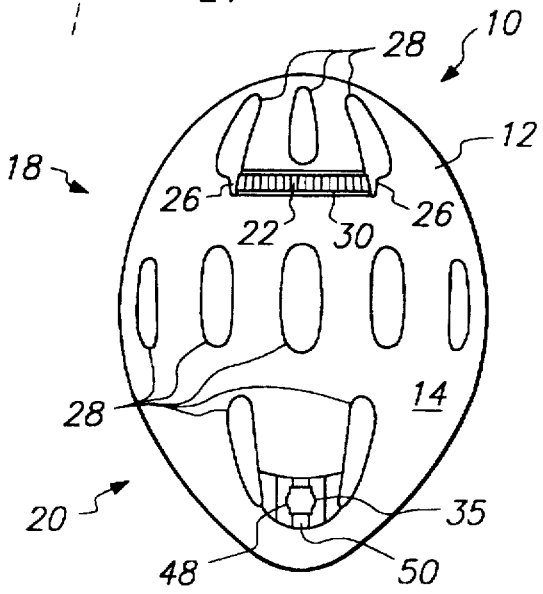
FIG. 2 is a top plan view showing the preferred embodiment of the inventive helmet.

In the preferred embodiment, chin strap 22 is attached to the front half of shell assembly 12 by passing through two slots 26. Slots 26 are located towards opposite sides of shell assembly 12, as seen in FIG. 2, and pass between interior surface 16 and exterior surface 14. In the preferred embodiment, slots 26 are extensions of air vents 28 and openly communicate therewith. Double sided tape (not shown) is preferably used to retain the middle of chin strap 22 in a recessed channel 30. Alternatively, two chin straps (not shown) can be employed, each strap terminating on one side of the helmet.

In use, chin strap 22 extends from the wearer's chin up along one side of the face, up inside shell assembly 12 between interior surface 16 and the wearer's head, through one of the slots 26, along recessed channel 30 in exterior surface 14, down through the other slot 26, and down a similar path on the opposite side of the head back to the chin. When helmet 10 is placed on the wearer's head, the two ends of chin strap 22 are fastened together under the chin with buckle 24. One end of chin strap 22 is permanently fastened to buckle 24, such as with stitching, and the other end slidably engages buckle 24 to allow for adjustment of chin strap 22.

Figure 4:
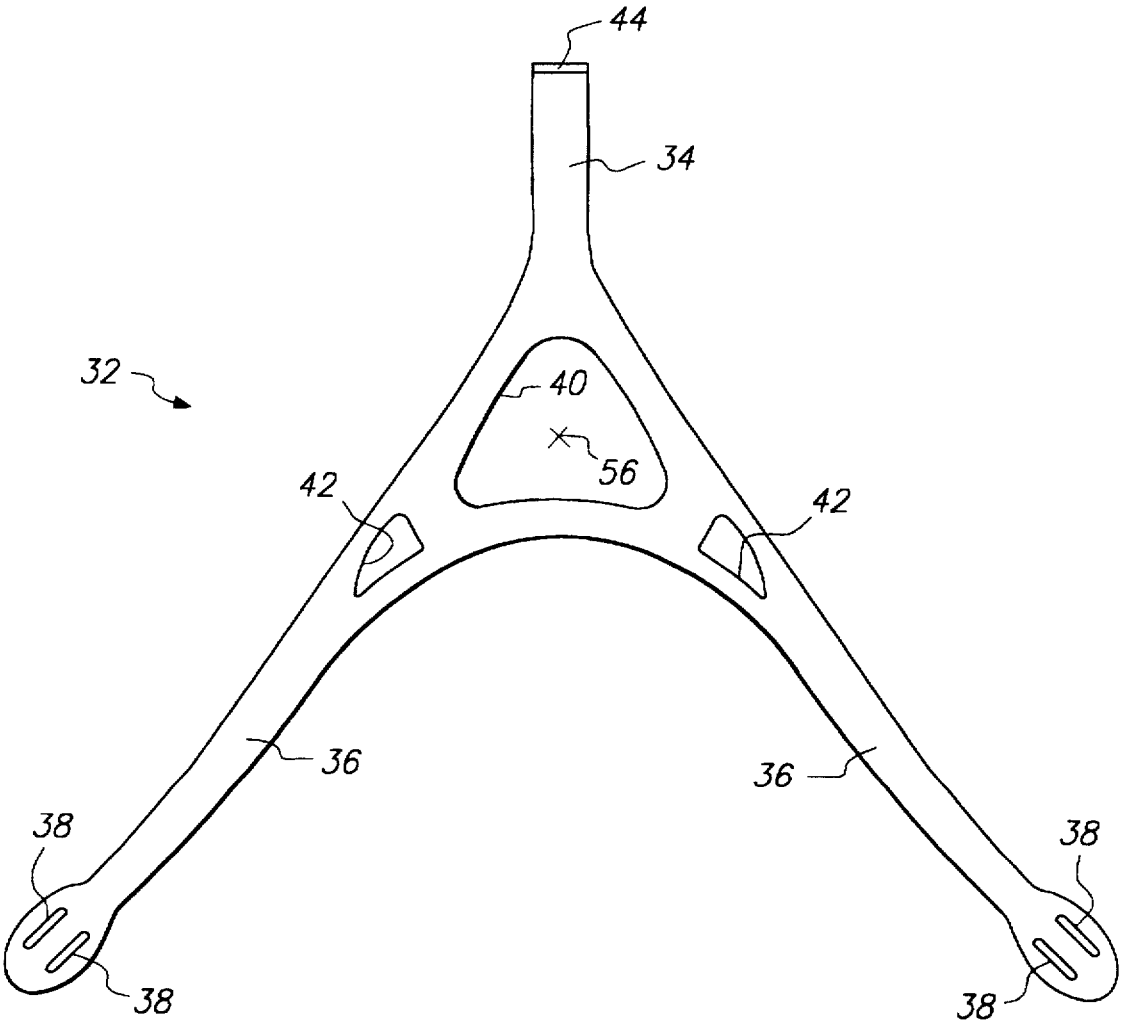
FIG. 4 is a plan view showing the back strap member of the preferred embodiment laid flat.

Acting in cooperation with chin strap 22, a back strap member 32 is provided on helmet 10. As best seen in FIG. 4, back strap member 32 preferably has the general shape of an inverted Y. The upper leg 34 is attached to the rear half 20 of shell assembly 12 with anchor 35. Back strap member 32 extends down over the occipital region of the wearer's head. Lower legs 36 curve around opposite sides of the head and each connect to one side of chin strap 22. With this arrangement, the occipital region of the head is cradled by back strap member 32, and the inwardly curved portion of the back of the head and the chin are fully utilized to comfortably yet securely retain helmet 10 on the wearer's head.

The length of lower legs 36 is designed such that chin strap 22 is deflected rearward from a straight orientation along both sides of the head. This ensures that when chin strap 22 is tightened, sufficient pressure is applied by back strap member 32 against the occipital region of the head to retain helmet 10 snugly. With the general orientation between back strap 32 and chin strap 22 shown in FIG. 1, a particular helmet is able to fit a fairly broad range of head sizes while maintaining a proper balance of tension between straps 32 and 22.

In the preferred embodiment, lower legs 36 are slidably attached to chin strap 22. Two slits 38 (as best seen in FIG. 4) are provided in the forward end of each lower leg 36. Chin strap 22 passes through each slit 38 and allows lower legs 36 to be slid along chin strap 22 with only slight resistance.

While providing improved engagement with the wearer's head, back strap member 32 also replaces one of the straps in a traditional Y-strap arrangement. The inventive helmet 10 more intuitive to put on, and is easier to adjust. The first time the helmet is put on and secured with buckle 24, the free end of chin strap 22 is pulled snug and the lower legs 36 of back strap member 32 are slid into a generally horizontal position. Thereafter, buckle 24 need only be released and buckled when helmet 10 is taken off and put on, respectively. The need for complex adjustments such as balancing the lengths of multiple straps is eliminated.

Figure 3:
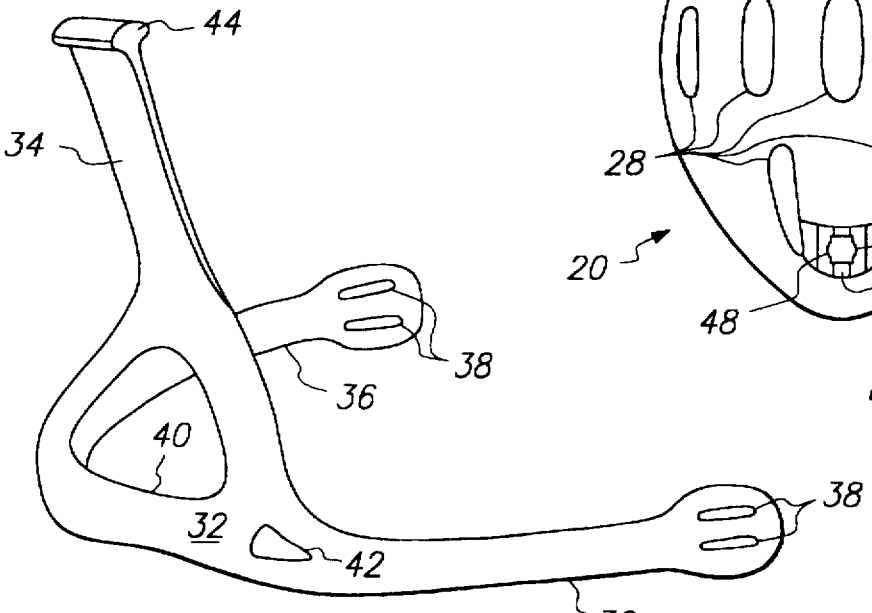
FIG. 3 is a perspective view showing the back strap member of the preferred embodiment.

Referring to FIGS. 3 and 4, back strap member 32 is preferably provided with a triangular cutout 40 where lower legs 36 connect with upper leg 34. The resulting configuration more comfortably conforms to the occipital region of the wearer's head and more evenly distributes the tension in legs 34 and 36 while staying properly placed on the head. Secondary cutouts 42 are preferably provided for similar reasons. It is envisioned that secondary cutouts 42 will be reduced in size to ensure that back strap member 32 has ample strength to prevent helmet 10 from being pulled off during an accident.

Back strap member 32 is preferably made from a high strength thermoplastic or thermoplastic elastomer, such as Hytrel from Dupont. It can be molded flat and as a single piece to maintain the simplicity and low cost of helmet 10.

Figure 5:
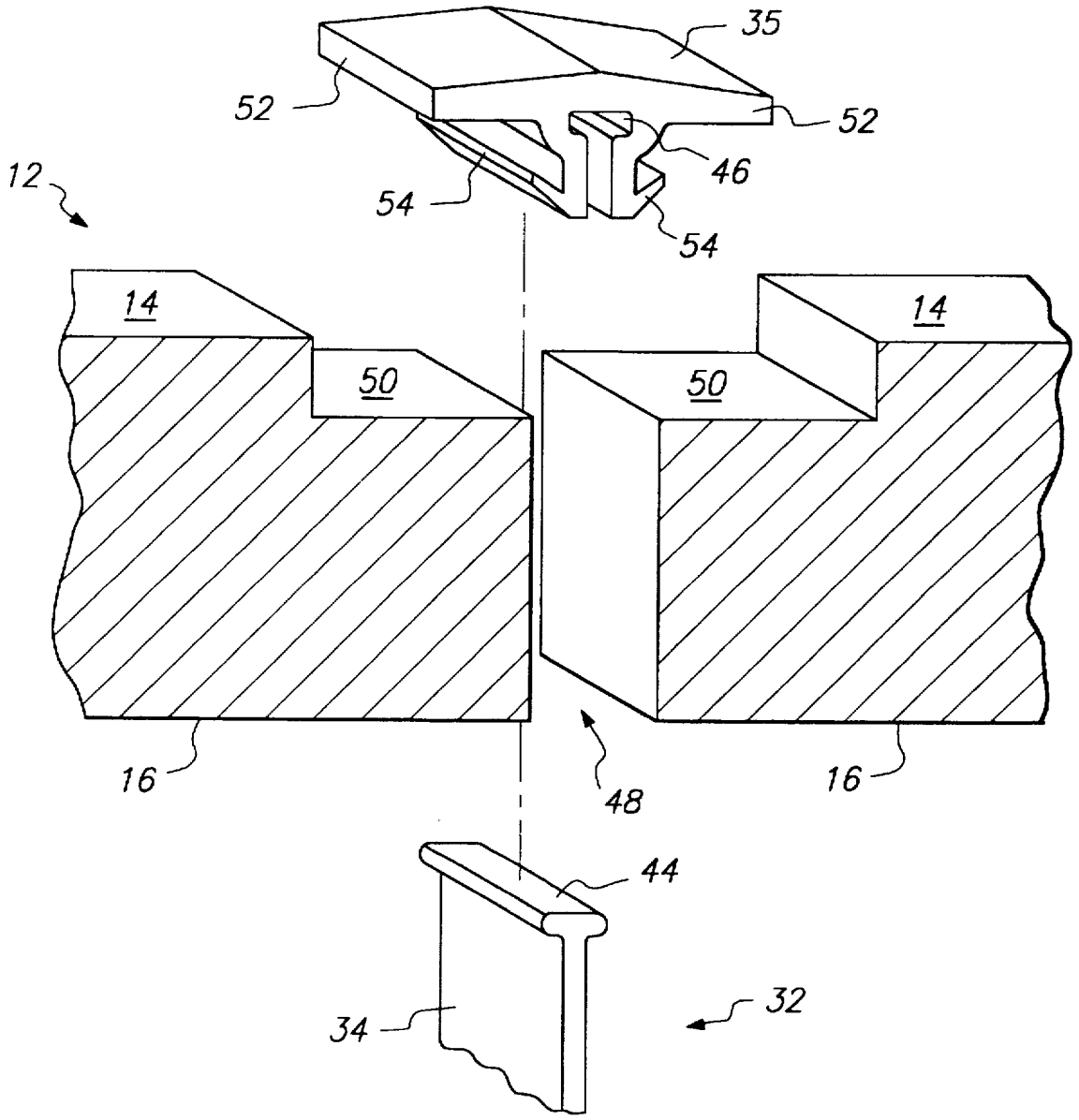
FIG. 5 is an exploded, fragmentary perspective view showing a portion of the back strap member and anchor of the preferred embodiment.

Referring to FIG. 5, the preferred means for attaching upper leg 34 of back strap member 32 to shell assembly 12 is shown. Upper leg 34 is provided with a T-shaped bead 44 along its top edge. A complementary shaped channel 46 is formed in anchor 35 for slidably receiving bead 44. During assembly of helmet 10, upper leg 34 is pushed up through slot 48 in shell 12 until bead 44 protrudes above exterior recessed surfaces 50. Anchor 35 is then slid over bead 44 to captivate anchor 35 on upper leg 34. Preferably, the far side of channel 46 (not shown) is closed to prevent bead 44 from sliding all the way through. As upper leg 34 is withdrawn back into slot 48, anchor 35 is drawn into slot 48 until the underside of wings 52 contact recessed surfaces 50. Barbs 54 help prevent vertical movement of anchor 35, while the lateral walls (not shown) of slot 48 prevent excessive sideways movement of upper leg 34.

The inventive retention system can be easily retrofitted to existing helmet designs by providing slot 48 and recessed surfaces 50 in the proper location (if they do not already exist) for receiving anchor 35 or a similar attachment member. Preferably, a skin (not shown but well known in the art) is used to cover anchor 35 and the entire top of shell assembly 12.

As an alternative embodiment (not shown), three (or any other number of) parallel beads 44 can be vertically spaced apart on upper leg 34. Channel 46 in anchor 35 would then be formed with three widened portions for receiving the three beads 44. These additional beads 44 would provide extra gripping surface for retaining back strap member 32 on helmet 10.

Referring again to FIG. 4, further details of the preferred embodiment of back strap member 32 will be described. Only one size back strap member 32 need be used for each size helmet. In other words, all toddler size helmets can be equipped with a first size back strap member 32, all child size helmets can be equipped with a second size back strap member 32, and so forth. The back strap member 32 shown in FIG. 4 and described below is used is conjunction with a medium size adult helmet.

Back strap member 32 has a nominal thickness of 0.065 inches. Upper leg 34 is 0.5 inches wide, and its end is 3.2 inches from a central point 56, as shown. Each lower leg 36 varies in width from about 0.5 inches near secondary cutout 42, 0.37 inches near its distal end, and 0.69 adjacent to slits 38. The end of each lower leg 36 is 7.0 inches from central point 56.

The above descriptions and drawings are for illustrative purposes only, and are not exhaustive of possible alternate embodiments of the invention. It is to be understood that the present invention is not limited to the sole embodiments described above and illustrated herein, but encompasses any and all variations falling within the scope of the appended claims and their equivalents.

What is claimed as the invention is:

1. A sport helmet comprising:

a rigid shell assembly for substantially covering a top portion of a wearer's head;

a chin strap attached to the shell assembly for extending down one side of the wearer's head alongside of the wearer's face, under the wearer's chin and up along the opposite side of the face back to the shell assembly; and a back strap member attached to and depending from a rear portion of the shell assembly for extending over the occipital region of the wearer's head, the member having two lower legs each for extending around an opposite side of the wearer's head and connecting to the chin strap generally adjacent to a wearer's cheek, each lower leg terminating on the chin strap such that each lower leg has a non-adjustable fixed length, the lower legs being rigidly interconnected in a fixed, non-adjustable manner, the chin strap and back strap member cooperating to secure the shell assembly from movement on and removal from the wearer's head by engaging the wearer's chin and the inwardly curved portion on the posterior of the wearer's head.

2. A sport helmet according to claim 1 wherein the back strap member is a unitary piece formed from a single piece of material.

3. A sport helmet according to claim 2 wherein the back strap member is formed from a thermoplastic elastomer.

4. A sport helmet according to claim 1 wherein each of the two lower legs has a distal end slidably attached to the chin strap.

5. A sport helmet according to claim 4 wherein two slits are formed in each distal end for slidably receiving the chin strap.

6. A sport helmet according to claim 1 wherein the chin strap is the only strap that has an adjustable length.

7. A sport helmet according to claim 1 wherein the chin strap and the back strap are the only straps on the helmet.

8. A sport helmet according to claim 1 wherein the lower legs of the back strap member have a length such that the chin strap is drawn back from the wearer's face where the lower legs connect to the chin strap.

9. A sport helmet according to claim 1 wherein the back strap member has exactly three attachment ends consisting of an upper leg connected to a rear portion of the shell assembly and the two lower legs connected to the chin strap.

10. A sport helmet according to claim 9 wherein the upper leg has a bead formed along a top edge for engaging a complementary shaped anchor that resides in a slot in the shell assembly for attaching the upper leg to the shell assembly.

11. A sport helmet according to claim 1 wherein the back strap member includes a triangular shaped cutout through a middle portion which is located over the occipital region of the wearer's head.

12. A sport helmet according to claim 1 wherein the chin strap is a single continuous loop slidably attached to a front portion of the shell assembly, the chin strap having two ends that fasten together underneath the wearer's chin.

13. A sport helmet comprising:

a rigid shell assembly for substantially covering a top portion of a wearer's head;

a chin strap attached to the shell assembly for extending down one side of the wearer's head alongside of the wearer's face, under the wearer's chin, and up alone the opposite side of the face back to the shell assembly; and a back strap member attached to and depending from a rear portion of the shell assembly for extending over the occipital region of the wearer's head, the member having two lower legs each for extending around an opposite side of the wearer's head and connecting to the chin strap generally adjacent to a wearer's cheek, each lower leg terminating on the chin strap such that each lower leg has a non-adjustable fixed length, the chin strap and back strap member cooperating to secure the shell assembly from movement on and removal from the wearer's head by engaging the wearer's chin and the inwardly curved portion on the posterior of the wearer's head, wherein the back strap member is a unitary piece formed from a single piece of material, and wherein the back strap member has an inverted Y-shape.

14. A unitary back strap member for use in conjunction with a sport helmet retention apparatus, the member comprising:

an upper leg having an upper end with means for attaching the back strap to a rear portion of a helmet; and two lower legs attached to the upper leg opposite the upper end, the lower legs extending from the upper leg in opposite direction, each lower leg having a distal end with means for receiving a helmet chin strap therethrough, the lower legs each having a length such that the distal ends are positioned adjacent to the wearer's cheeks, the upper leg together with both of the lower legs being formed from a single piece of material.

15. A unitary back strap member according to claim 14 wherein the back strap member is formed in a substantially planar orientation.

16. A unitary back strap member for use in conjunction with a sport helmet retention apparatus, the member comprising:

an upper leg having an upper end with means for attaching the back strap to a rear portion of a helmet; and two lower legs attached to the upper leg opposite the upper end, the lower legs extending from the upper leg in opposite directions, each lower leg having a distal end with means for receiving a helmet chin strap therethrough, the lower legs each having a length such that the distal ends are positioned adjacent to the wearer's cheeks, the upper and lower legs being formed from a single piece of material, wherein the back strap member has an inverted Y-shape.

17. A unitary back strap member for use in conjunction with a sport helmet retention apparatus, the member comprising:

an upper leg having an upper end with means for attaching the back strap to a rear portion of a helmet; and two lower legs attached to the upper leg opposite the upper end, the lower legs extending from the upper leg in opposite directions, each lower leg having distal end with means for receiving a helmet chin strap therethrough, the lower legs each having a length such that the distal ends are positioned adjacent to the wearer's cheeks, the upper and lower legs being formed from a single piece of material, wherein the upper and lower legs join in a central region, the central region having a cutout portion therethrough such that each of the legs is interconnected to each of the other legs by an individual band segment.

18. A sport helmet comprising:

a rigid shell assembly for substantially covering a top portion of a wearer's head;

a chin strap attached to the shell assembly for extending down one side of the wearer's head alongside of the wearer's face, under the wearer's chin, and up along the opposite side of the face back to the shell assembly; and a unitary back strap member having an upper leg attached to and depending from a rear portion of the shell assembly for extending over the occipital region of the wearer's head, the member having two lower legs each for extending around an opposite side of the wearer's head and slidably connecting to the chin strap generally adjacent to a wearer's cheek, each lower leg terminating on the chin strap such that each lower leg has a non-adjustable fixed length, the upper and lower legs integrally formed from a single piece of material having an inverted Y-shape, the chin strap and back strap member cooperating to secure the shell assembly from movement on and removal from the wearer's head by engaging the wearer's chin and the inwardly curved portion on the posterior of the wearer's head.

* * * * *

UNITED STATES PATENT AND TRADEMARK OFFICE

CERTIFICATE OF CORRECTION

PATENT NO.: 5,774,901
DATED: July 7, 1998
INVENTOR(S): Don Satoshi Minami

It is certified that errors appear in the above-identified patent and that said Letters Patent is hereby corrected as shown below:

In Col. 5, line 14 change "chin" to --chin,--
In Col. 6, line 3 change "alone" to --along--
In Col. 6, line 28 change "direction" to --directions--
In Col. 6, line 59 add --a-- before "distal end"

Signed and Sealed this

Eighth Day of June, 1999

*Attest:*

Q. TODD DICKINSON

*Attesting Officer*

*Acting Commissioner of Patents and Trademarks*